United States Patent [19]

Valente

[11] 4,350,036

[45] Sep. 21, 1982

[54] APPARATUS FOR POINTING WORK PIECES

[75] Inventor: Raymond L. Valente, Kankakee, Ill.

[73] Assignee: Vale Industries Inc., Pontiac, Ill.

[21] Appl. No.: 119,356

[22] Filed: Feb. 7, 1980

[51] Int. Cl.[3] ..... B21D 41/04

[52] U.S. Cl. ..... 72/402

[58] Field of Search ..... 72/402, 399, 410, 367, 72/189, 409; 29/237, 517

[56] References Cited

U.S. PATENT DOCUMENTS

| | | | |
|---|---|---|---|
| 2,999,405 | 9/1961 | Ewart | 72/402 |
| 3,073,374 | 1/1963 | Valente | 72/402 |
| 3,154,978 | 11/1964 | Baker | 72/416 |
| 3,245,247 | 4/1966 | Valente | 72/402 |
| 3,292,414 | 12/1966 | Goeke | 72/402 |
| 3,370,451 | 2/1968 | Schuetz | 72/402 |
| 3,417,598 | 12/1968 | Valente | 72/469 |
| 4,043,172 | 6/1977 | Schmittov | 72/409 |

FOREIGN PATENT DOCUMENTS

| | | | |
|---|---|---|---|
| 449558 | 9/1927 | Fed. Rep. of Germany | 72/402 |
| 2709163 | 9/1978 | Fed. Rep. of Germany | 72/402 |
| 8105 | of 1915 | United Kingdom | 72/402 |
| 567355 | 2/1945 | United Kingdom | 72/402 |

*Primary Examiner*—Gene Crosby

*Attorney, Agent, or Firm*—Trexler, Bushnell & Wolters, Ltd.

[57] ABSTRACT

A tube shaping machine includes a plurality of dies each having a substantially continuous, unbroken working surface. These dies are mounted with the working surfaces positioned one adjacent to the next so as to form a tube-receiving aperture therethrough, which aperture defines in cross-section regular polygon. The dies are substantially identical in configuration, this configuration being such that reciprocating each of the dies along a predetermined straight line throughout a range of positions between a fully open position and a fully closed position of the tube-receiving aperture maintains a similar regular polygonal cross-sectional shape of said tube-receiving through aperture throughout said range of positions.

11 Claims, 5 Drawing Figures

66
64
46
48
57
44
42
60
62
40
70
26
71
14
20
32
56
10
39
12
38
42
44

APPARATUS FOR POINTING WORK PIECES

BACKGROUND OF THE INVENTION

This invention relates generally to apparatus used for forming a work piece and more particularly to a novel die for a tube pointing machine.

It is well known in the tube fabricating arts to reduce the diameter of a tube by forcing the tube through a drawing machine. In order to facilitate initial insertion of the tube into this drawing machine, the diameter of a leading end portion thereof is first reduced. This latter practice is commonly referred to as tube pointing.

Generally speaking, machines provided for the tube pointing operation utilize a plurality of relatively movable forming dies to rather abruptly reduce the diameter of an end portion of a tube. These forming dies are often mounted with work engaging surfaces movable inwardly about a common axis relative to the tube so as to quickly yet effectively reduce the size of a leading portion of the tube by causing it to fold in upon itself.

Since this tube pointing operation is auxiliary to the diameter reduction operation, it is desirable to accomplish this pointing as quickly and simply as possible with but a minimum of handling of the tube required. Moreover, it is important that tube pointing machinery be capable of fairly rapid and frequent operation and yet remain highly reliable over a relatively long period of demanding and repetitive use.

One problem which has been encountered with prior art tube pointing machines lies in providing adequate support for the tube throughout the pointing operation, both peripherally and longitudinally. The provision of such adequate support tends to minimize the amount of handling necessary, and moreover permits conveniently location of the machine immediately adjacent the related tube diameter reduction machinery. Both of these tendencies also help to optimize the speed with which the entire tube forming process may be carried out. Moreover, such positive gripping of the tube during the pointing operation avoids any need for auxiliary handling machinery or equipment. Advantageously, therefore, with the present invention, a single worker may readily and safely insert the tube to be pointed into the novel apparatus of the invention, without the aid of any additional positioning or handling machinery.

Additionally, some prior art pointing devices have encountered problems with portions of the tube breaking off, extruding or otherwise migrating into gaps between moving dies or other related moving parts of the machinery. Needless to say, such an occurrence can damage the tube forming machine, and is therefore most undesirable.

OBJECTS OF THE SUMMARY OF THE INVENTION

It is the general object of the present invention to provide a new and improved tube forming machine.

A more specific object is to provide a tube pointing machine employing a novel and improved die structure.

A related object is to provide a tube pointing machine employing a novel die structure which is adapted to substantially completely engage the portion of the tube to be formed, both peripherally and longitudinally, substantially throughout the forming operation.

A further object is to provide a tube pointing machine in accordance with the foregoing objects which is relatively simple in its structure and yet avoids the problems associated with prior art machines, while remaining highly reliable in operation.

BRIEF DESCRIPTION OF THE DRAWINGS

Other objects, features and advantages of the present invention will become more readily apparent upon reading the following detailed description of the illustrated embodiment in conjunction with the accompanying drawings, wherein.

DETAILED DESCRIPTION OF THE DETAILED EMBODIMENT

Figure 1:
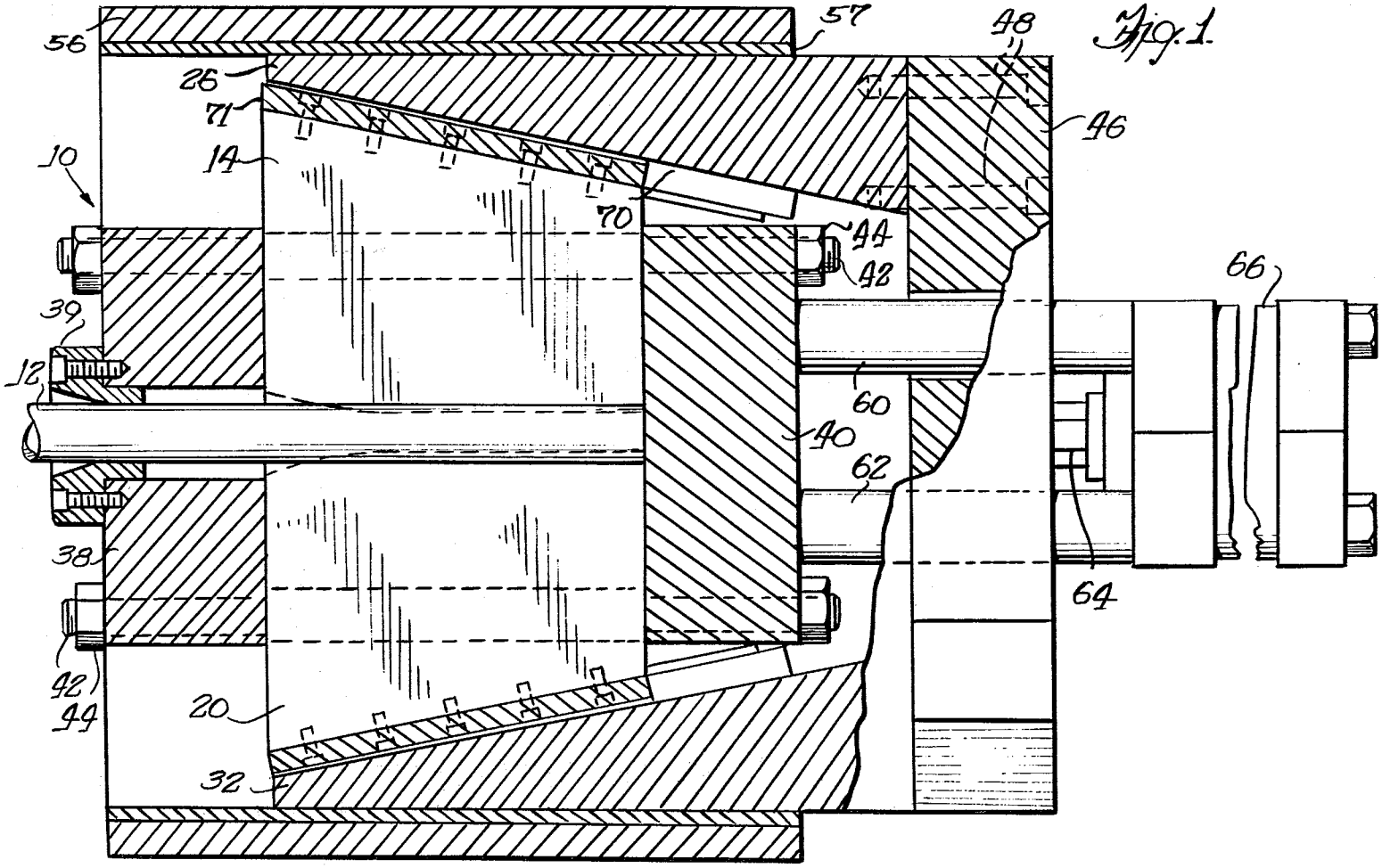
FIG. 1 is a side elevation, partially cut away and partially in section, of a tube forming machine constructed in accordance with the principles of the present invention.
Figure 2:
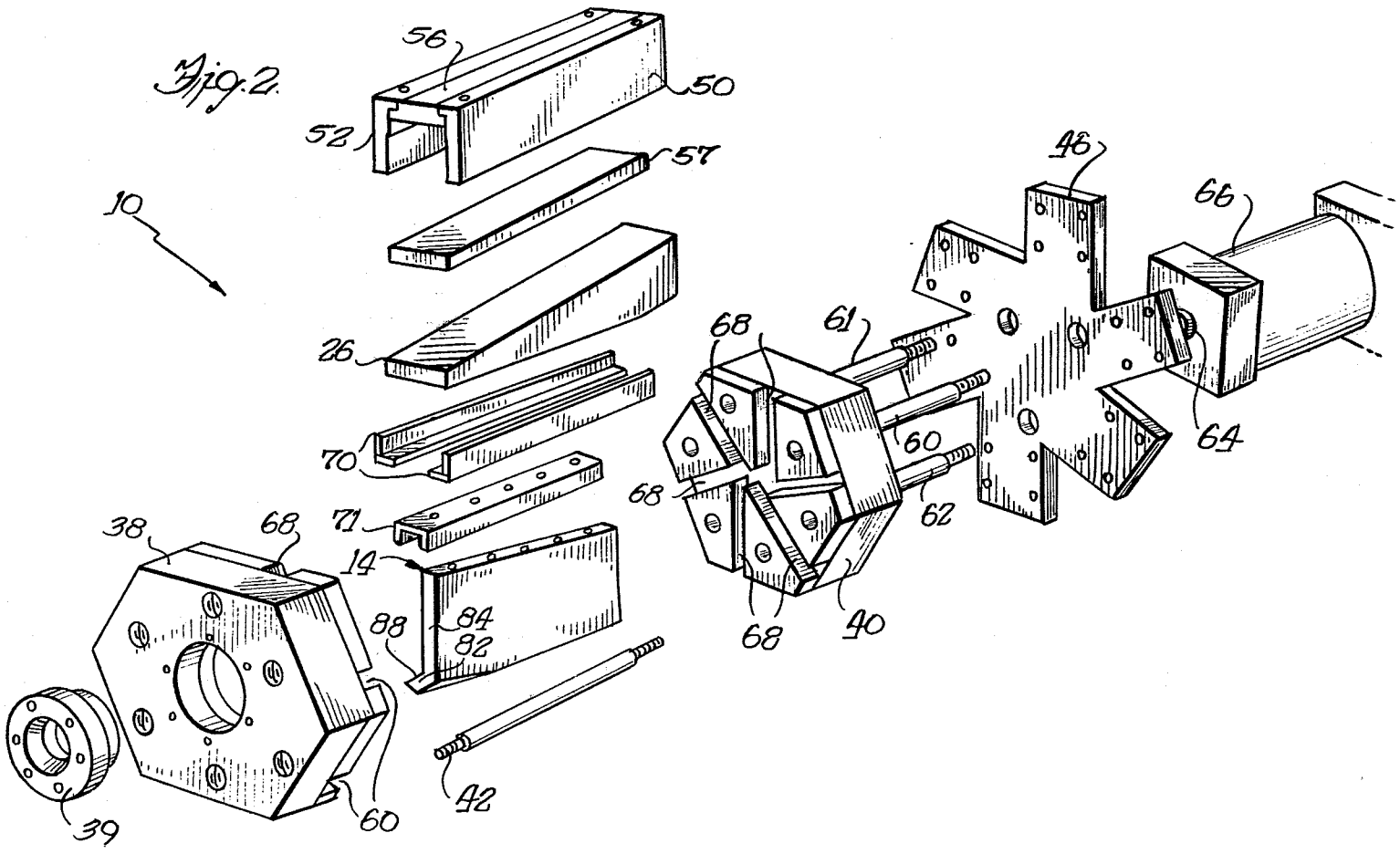
FIG. 2 is a partially exploded partial perspective view of the tube forming machine of FIG. 1.
Figures 3, 4, 5:
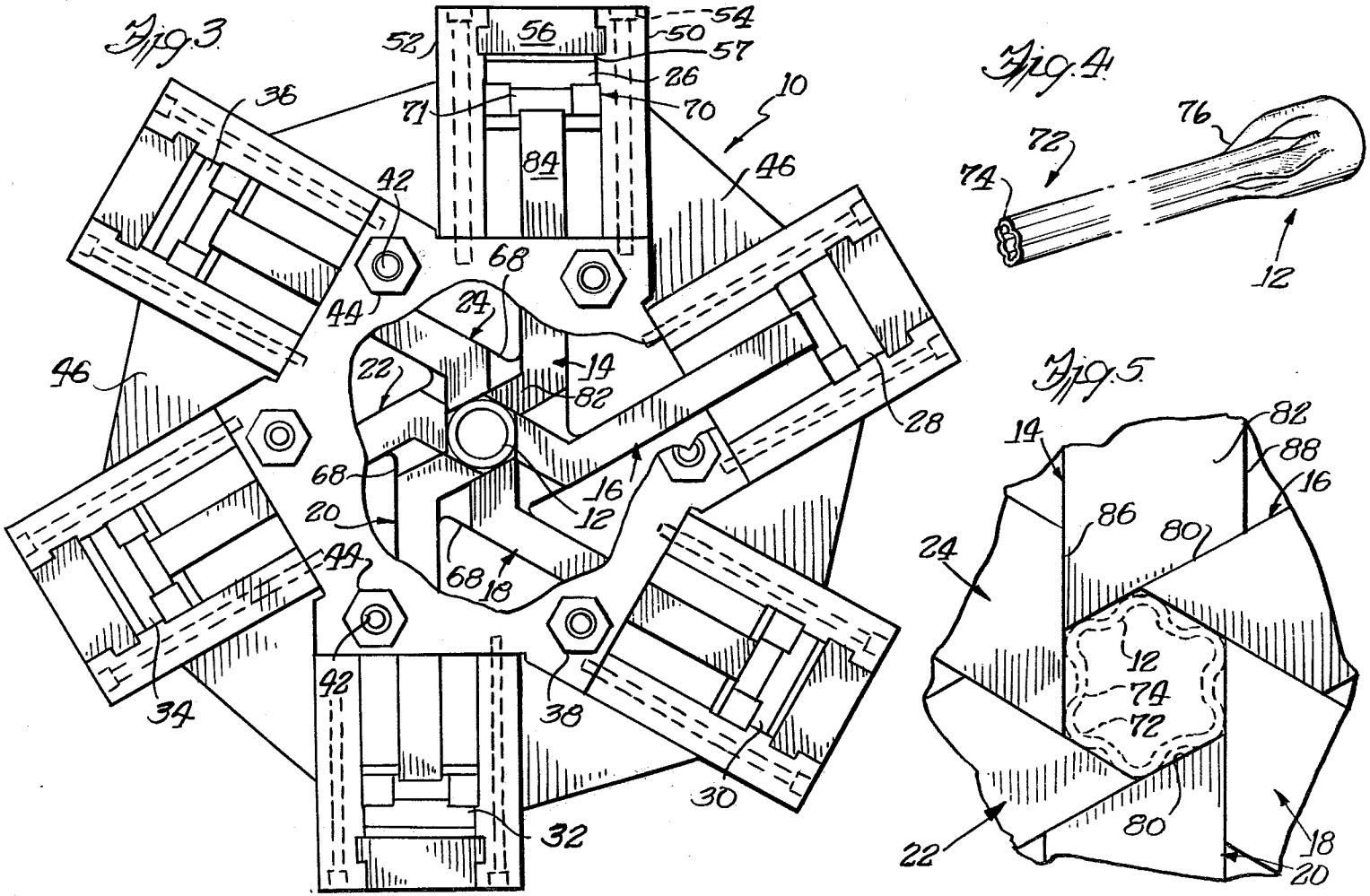
FIG. 3 is a front elevation, partially cut away and partially in section, of a tube forming machine of FIG. 1.
FIG. 4 is a perspective view of a tube, as formed by the tube forming machine of FIGS. 1 and 2; and, FIG. 5 is an enlarged view of a portion of the tube forming machine as viewed in FIG. 2, during a subsequent portion of the operation thereof.

Referring now to the drawings and initially to FIGS. 1, 2 and 3, there is shown a tube shaping machine 10 for pointing or otherwise shaping a generally cylindrical tube 12. A plurality of forming or pointing dies 14, 16, 18, 20, 22 and 24 are each mounted in sliding engagement with one of a plurality of longitudinally rearwardly extending wedge members 26, 28, 30, 32, 34 and 36.

The dies 14–24, inclusive, are mounted generally between front and rear housing plates 38 and 40. An entry guide orifice 39 is provided at the leading face of front housing plate 38. Suitable threaded tie rods 42 and cooperating bolts 44 hold the dies 14–24, inclusive, against longitudinal motion relative to these end plates 38 and 40, while allowing sliding radial movement of the dies 14–24, inclusive. These tie rods 42 are evenly spaced about the plates 38, 40, as viewed best in FIGS. 2 and 4. The wedges 26–36, inclusive, are mounted at their trailing ends on a wedge carrying plate designated generally 46, by suitable means such as mounting bolts 48. Accordingly, the wedges 26–36, inclusive are all axially movable in unison with the mounting plate 46.

As each of these dies and wedge members and the parts cooperating therewith are substantially identical only the die 14 and corresponding wedge member 26 and their cooperating parts, as shown in FIG. 1 will be described in detail. A suitable housing is provided for each wedge and its associated die, together with associated structure for converting the axial movement of the wedges 26–36 into radial movement of the dies 14–24. The housing is formed generally of side or riser plates 50, 52 which are secured to the front and rear die guides or plates 38, 40 by means of suitable bolts 54 (see FIG. 3). The tops of these housings are defined by plates 56, which are in a key-slot engagement with the side plates 50, 52. The wedge carrying plate 46 is slidingly movable in a horizontal direction, as viewed in FIG. 2, over three generally cylindrical slide rod members, (of which two are visible in FIG. 1) designated by the reference numerals 60, 61, 62. This plate 46 is moved by means of a ram 64, which is reciprocated by means of fluid pressure in a hydraulic cylinder 66. A suitable hydraulic control for operation of the cylinder 66 is also provided, but is not shown, as it forms no part of the present invention.

Referring to FIG. 2, a typical wedge 26 is joined with a typical die 14 by means of a pair of tracks or guides 70 which slidably engage a tie bar or glide 71. The tracks or guides 70 are rigidly attached to the wedge 26, while the tie bar or glide 71 is rigidly attached to the die 14. Consequently, the tie bar or glide 71 rides in the guides or tracks 70, as the wedge 26 reciprocates axially, so as to reciprocate the die 14 radially.

Consequently, as the wedges 26–36 reciprocate axially in unison with the ram 64 and plate 46, they cause a corresponding radially directed reciprocation of the dies 14–24, inclusive. As best seen in FIG. 3, the dies are guided in this radial reciprocation by the guide slots or ways, 68, provided therefore in the front and rear housing plates 38 and 40. The external control (not shown) also regulates the extent of the radial reciprocation of the dies 14–24, inclusive.

Referring now briefly to FIG. 4, the end portion of a typical tube member 12 which has been pointed by the machine 10 is illustrated. A shaped or pointed end portion 72 is seen to be of a substantially reduced diameter following its pointing by the machine 10. Generally speaking, the tube end portion 12 will be formed by the machine into a plurality of arcuate lobes or ridges 74 which extend axially or longitudinally. These ridges 74 terminate in an arcuate tapered shoulder portion 72 which tapers down gradually from the main body portion of tube 12 into the formed or pointed end portion 72. This pointed or shaped tube 12 may thus be readily inserted into a further forming machine by inserting the reduced end or pointed portion 72 therein. It will be noticed, in FIG. 1, that the entering portion of the dies 14–24, inclusive, exhibits a corresponding taper, to insure this relatively gradual taper of the tube 12 to the pointed end portion 72. This structure serves to avoid any rupturing or breaking of the tube 12 which might occur absent such a gradual taper.

Reference is next invited to FIGS. 3 and 5, wherein the novel configuration and arrangement of the dies 14–24, inclusive, in accordance with the present invention is illustrated. It will be initially noted that in FIG. 3 the dies 14–24 are shown substantially in their fully open position, the tube 12 therein being in its original unformed or unpointed condition. FIG. 5, on the other hand, shows the dies substantially in their fully closed position with respect to the tube 12, the lobes or arcuate ridges 74 of end part 72 of the tube 12 having been formed thereby.

Initially, it will be noted that the dies 14–24 in the illustrated embodiment are six in number. The invention is not limited, however, to this particular number or configuration of the dies. Rather, as the ensuing discussion will illustrate, the principles of the invention are equally applicable to any number of dies, which may be adjacently located so as to define, between their facing surfaces, a polygon. Hence, as few as three dies may be utilized in accordance with the principles of the present invention. The six dies illustrated, however, are in accordance with one practical and preferred form of the invention.

For the present discussion, the structure of the die 14 will be described, it being understood that the remaining dies are substantially identical therewith. The die 14 includes a working surface or face 80 which is supported by a first or die support portion 82. The support portion 82 is in turn supported by an actuating portion 84 (see FIG. 3), the opposite end of this actuating portion being in engagement with the corresponding wedge 32, as heretofore described, to facilitate the radial reciprocation of the die 20.

In accordance with a feature of the invention, the face 80 is substantially planar, while the corresponding faces or working surfaces of the remaining dies are similarly planar and arrayed or arranged with respect to thereto so as to substantially define the sides of a regular hexagon. Cooperatively, the sides forming the support portion 82 are formed with respect to the face 80 in such a fashion that a first of these sides 86 is substantially coplanar for sliding engagement with the next succeeding working surface or face of the hexagon, while the opposite side 88 is parallel therewith.

In similar fashion, the actuating portion 84 is formed at an angle with respect to the support portion 82 such that the generally radial inward movement of the die 20 will cooperate with the other dies to maintain a similar regular hexagonal aperture or opening therebetween as the dies reciprocate both inwardly and outwardly. In order to accomplish this, the actuating portion 84 is formed at an angle with respect to the face 80 such that its side walls are substantially parallel with a line bisecting the polygon from a point adjacent the junction of the face 80 with the next succeeding face in a counterclockwise direction as viewed in FIGS. 3 and 5. It will be noted that the direction of reciprocal radial movement of the die 20 is along this same axis or line. Hence, all of the dies 14–24, are actuated in unison by the movement of their corresponding wedges, so as to reciprocate a like amount for maintaining this similar, regular polygonal aperture therethrough, throughout the range of reciprocation.

Advantageously, the die faces 80 thus present a substantially solid and unbroken working surface to the work piece or tube 12 to be formed, substantially avoiding any breaking or extruding thereof or the entry of any stray pieces into the die structure or other portions of the apparatus 10. Moreover, this constant and unbroken working surface also provides substantially continuous support for the work piece or tube 12 throughout the pointing operation. This obviates the need for auxiliary machinery which has heretofore been required for the purpose of holding and positioning the tube or work piece during the pointing or forming operation. Rather, the present invention is substantially "self-aligning" with respect to the tube or work piece 12, requiring only that the operator insert the tube or work piece 12 through the guide orifice 39 prior to the forming or pointing operation. Thereafter, the continuous peripheral and longitudinal support afforded by the novel die arrangment of the present invention insures proper forming or pointing of the tube or work piece 12.

While the present invention has been illustrated and described with reference to a preferred embodiment, the invention is not limited thereto. On the contrary, various changes, modifications and alternatives may suggest themselves to those skilled in the art. The present invention includes such changes, alternatives and modifications insofar as they fall within the spirit and scope of the appended claims.

The invention is claimed as follows:

1. A tube shaping machine comprising a plurality of dies each having a substantially continuous, unbroken working surface, a substantially straight support leg for supporting said working surface and for defining lateral side portions thereof and forming a predetermined angle with respect to said working surface, and a substantially straight actuating leg for driving said support leg and formed continuously therewith and at a second predetermined angle with respect thereto, means for mounting said dies and for aligning said working surfaces one adjacent to the next so as to form a tube-receiving aperture therethrough, which aperture defines in cross-section a regular polygon, and means for simultaneously reciprocating each of said plurality of dies along a predetermined straight line throughout a range of positions between a fully open position and a fully closed position of said tube shaping machine while maintaining a similar regular polygonal cross-sectional shape of said tube-receiving through aperture throughout said range of positions.

2. A tube shaping machine according to claim 1 wherein said first predetermined angle is chosen so that the working surface and the lateral side portions defined by said support leg define, respectively, one side of said regular polygon, an extension of a side of said regular polygon next adjacent to said one side thereof, and a line parallel to said next adjacent side, and wherein said second predetermined angle is chosen such that movement of said die along the longitudinal axis of said actuating leg will maintain said similar regular polygonal cross-sectional shape of said aperture.

3. A tube shaping machine comprising a plurality of dies each having a substantially continuous, unbroken working surface, a substantially straight support leg for supporting said working surface and for defining lateral side portions thereof and forming a predetermined angle with respect to said working surface, and a substantially straight actuating leg for driving said support leg and formed continuously therewith and at a second predetermined angle with repect thereto, means for relatively mounting said dies so that the working surfaces thereof collectively define a tube-receiving aperture having a substantially continuous and unbroken composite working surface both peripherally and longitudinally, and means for simultaneously reciprocating each of said plurality of dies along a predetermined straight line throughout a range of positions between a fully open position and a fully closed position of said tube shaping machine, while maintaining a tube to be shaped therein substantially fully peripherally and longitudinally supported throughout said range of positions.

4. A tube shaping machine according to claim 3 wherein said working surfaces define a tube-receiving aperture which defines a regular polygon in cross-section.

5. A tube shaping machine according to claim 4 wherein said regular polygon comprises a hexagon.

6. A tube shaping machine according to claim 3 wherein said support leg has a pair of parallel, spaced apart, substantially flat lateral side surfaces and wherein said first predetermined angle is chosen so that said working surface and one of the lateral side surfaces of said support leg form, respectively, one side of said regular polygon and an extension of a side of said regular polygon next adjacent said one side of said regular polygon.

7. A tube shaping machine according to claim 6 wherein said second predetermined angle is chosen so that movement of the die along the longitudinal axis of the actuating leg will maintain a similar regular polygonal shape of said cross-section of said aperture.

8. A die for use with a tube forming machine, said die including a substantially flat, continuous and unbroken working surface capable of alignment with flat working surfaces of other like dies for collectively defining substantially the sides of a regular polygon, a substantially straight support leg for supporting said working surface, and for defining a pair of parallel, spaced apart lateral side portions of said working surface at a first predetermined angle with respect thereto, and a substantially straight actuating leg for driving said support leg and formed continuously therewith and at a second predetermined angle with respect thereto, said first predetermined angle being such that said working surface and one of the lateral side portions thereof define, respectively, one side of said regular polygon and an extension of a side of said regular polygon next adjacent to said one side of said regular polygon and said second predetermined angle being chosen so that movement of the die along the longitudinal axis of the actuating leg will maintain a similar regular polygon when said plurality of like dies are initially to aligned and thereafter simultaneously moved a like amount along their respective actuating leg longitudinal axes.

9. Apparatus according to claim 1 or claim 8 wherein said regular polygon comprises a hexagon.

10. Apparatus as set forth in claim 1, claim 3 or claim 8 wherein said working surface comprises a substantially flat, axially elongate portion comprising a major portion thereof, and a tapered leading end portion for substantially gradually deforming the longitudinal surface of said tube from its original form to the desired form.

11. Apparatus according to claim 8 or claim 7 wherein said second predetermined angle is chosen so that the longitudinal axis of said actuating leg is parallel with a line bisecting said regular polygon from the junction of said one side of said regular polygon with said next adjacent side thereof.

* * * * *

UNITED STATES PATENT AND TRADEMARK OFFICE

CERTIFICATE OF CORRECTION

PATENT NO. : 4,350,036

DATED : September 21, 1982

INVENTOR(S) : RAYMOND L. VALENTE

It is certified that error appears in the above-identified patent and that said Letters Patent is hereby corrected as shown below:

Column 6, line 37, change "to" to --so--.

Signed and Sealed this

*Twenty-eighth* Day of *December 1982*

[SEAL]

*Attest:*

GERALD J. MOSSINGHOFF

*Attesting Officer*

*Commissioner of Patents and Trademarks*